US008528121B2

(12) United States Patent
Stonecipher et al.

(10) Patent No.: US 8,528,121 B2
(45) Date of Patent: Sep. 10, 2013

(54) URINAL BRACKET

(75) Inventors: Scott W. Stonecipher, Kewaskum, WI (US); Peter Swart, Oostburg, WI (US); Steven Bauer, Sheboygan, WI (US); Jeffrey Laundre, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 13/326,144

(22) Filed: Dec. 14, 2011

(65) Prior Publication Data

US 2013/0152291 A1 Jun. 20, 2013

(51) Int. Cl.
*E03D 11/14* (2006.01)

(52) U.S. Cl.
USPC ..... 4/252.1

(58) Field of Classification Search
USPC ..... 4/252.1, 200, 226.11, 48.2, 191
See application file for complete search history.

(56) References Cited

U.S. PATENT DOCUMENTS

| | | | | |
|---|---|---|---|---|
| 1,531,253 | A | 3/1925 | Kaufman | |
| 2,549,357 | A | 4/1951 | Angelone | |
| 2,666,211 | A | 1/1954 | Schmid | |
| 3,198,554 | A | 8/1965 | Hartshorn, Jr. | |
| 3,400,411 | A | 9/1968 | Harvey | |
| 3,686,695 | A | 8/1972 | Mielback et al. | |
| 3,796,449 | A | 3/1974 | McLaughlin et al. | |
| 3,967,326 | A * | 7/1976 | Tammen | 4/252.5 |
| 4,185,334 | A * | 1/1980 | Izzi | 4/252.2 |
| 4,244,061 | A | 1/1981 | Webster et al. | |
| 5,090,738 | A | 2/1992 | Rakieski | |
| 5,139,833 | A | 8/1992 | Ohaus | |
| 5,143,407 | A | 9/1992 | Cokeh | |
| 5,248,171 | A | 9/1993 | Briet | |
| 5,380,015 | A | 1/1995 | Laflin et al. | |
| 5,470,111 | A | 11/1995 | Nelson et al. | |
| 5,636,878 | A | 6/1997 | Millward et al. | |
| 6,070,910 | A | 6/2000 | Hodges | |
| 6,283,158 | B1 | 9/2001 | Botsolas et al. | |
| 6,616,118 | B2 | 9/2003 | Nortier | |
| 7,124,451 | B2 | 10/2006 | Moore | |
| 7,622,178 | B2 | 11/2009 | Bogue et al. | |
| 7,758,086 | B2 | 7/2010 | Slunick et al. | |
| 7,950,886 | B2 | 5/2011 | Siegal | |
| 2003/0159203 | A1 | 8/2003 | Hoover | |

(Continued)

FOREIGN PATENT DOCUMENTS

| | | | |
|---|---|---|---|
| EP | 0345610 | A1 | 12/1989 |
| GB | 2241642 | A | 9/1991 |

(Continued)

OTHER PUBLICATIONS

International Search Report and Written Opinion for PCT/US2012/035601, mail date Nov. 15, 2012, 13 pages.

*Primary Examiner* — Lori Baker
(74) *Attorney, Agent, or Firm* — Foley & Lardner LLP

(57) ABSTRACT

A bracket for coupling a urinal to a soil pipe is provided. The bracket includes a body portion defining a first opening configured to be in fluid communication with the soil pipe, the body portion having a first surface configured to receive a resilient gasket. The bracket further includes an arm extending outwardly from the body portion, the arm having a structure configured to receive a fastener for coupling the bracket to the urinal, the structure having a first surface positioned forward of the first surface of the body portion.

21 Claims, 12 Drawing Sheets

(56) References Cited

U.S. PATENT DOCUMENTS

| | | | | |
|---|---|---|---|---|
| 2004/0150132 | A1 | 8/2004 | Rowley | |
| 2008/0000018 | A1 | 1/2008 | Laher | |
| 2011/0162132 | A1 | 7/2011 | Nuri et al. | |
| 2011/0162133 | A1* | 7/2011 | DeWitt et al. | 4/252.6 |

FOREIGN PATENT DOCUMENTS

| | | | |
|---|---|---|---|
| JP | 9078670 | A | 3/1997 |
| JP | 2000336735 | A | 12/2000 |
| JP | 2004143922 | A | 5/2004 |
| JP | 2008266916 | A | 11/2008 |

* cited by examiner

SECTION B - B

SECTION C - C

URINAL BRACKET

BACKGROUND

The present disclosure relates generally to the field of brackets for sanitary fixtures. More specifically, the present disclosure relates to the field of brackets for coupling a soil pipe to a urinal.

Urinal brackets are used to couple a urinal to a soil pipe and to form a watertight seal therebetween. Due to the acidic nature of urine, cleaning products, and other urinal effluent, corrosion resistant materials, such as brass or plastic, are typically used. However, corrosion resistant metals, such as brass, tend to be costly. On the other hand, some plastics which are rigid enough to resist bending tend to crack under the loads. Thus, there is a need for an improved urinal bracket.

SUMMARY

One embodiment relates to a bracket for coupling a urinal to a soil pipe. The bracket includes a body portion defining a first opening configured to be in fluid communication with the soil pipe, the body portion having a first surface configured to receive a resilient gasket. The bracket further includes an arm extending outwardly from the body portion, the arm having a structure configured to receive a fastener for coupling the bracket to the urinal, the structure having a first surface positioned forward of the first surface of the body portion.

Another embodiment relates to a mounting device for securing a urinal to a soil pipe. The mounting device includes a substrate formed of a first material and including a first opening and at least one second opening, the first opening configured for the passage therethrough of effluent from the urinal to the soil pipe and the at least one second opening configured to receive a fastener passing therethrough to couple the mounting device to the urinal. The mounting device further includes a covering at least partially disposed over the substrate. The covering is formed of a second material that is different than the first material.

Another embodiment relates to a bracket for coupling a urinal to a soil pipe. The bracket includes a body portion defining a first opening configured to be in fluid communication with the soil pipe, an arm extending outwardly from the body portion and configured to receive a fastener for coupling the bracket to the urinal, and a recess provided at least partially around the first opening to allow flexure of the arm relative to the body portion while reducing bending of the body portion.

DETAILED DESCRIPTION

Figure 1:
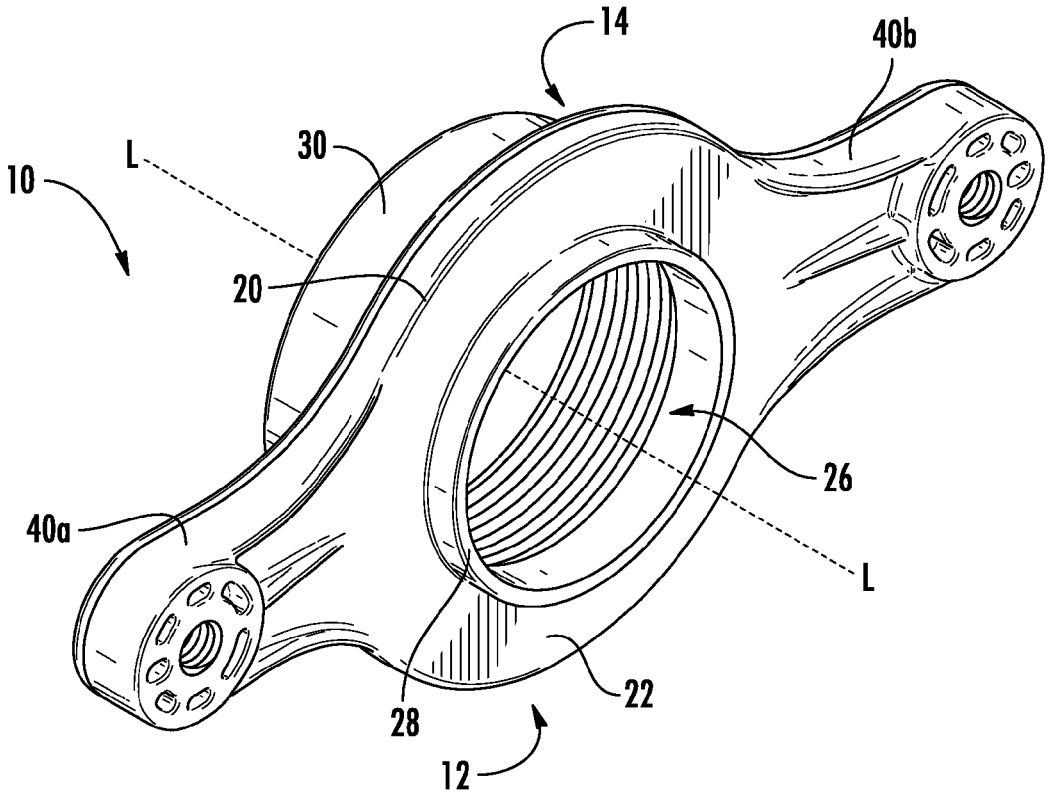
FIG. 1 is a perspective view of a urinal bracket, shown according to an exemplary embodiment.

Referring generally to the FIGURES, a urinal bracket and components thereof are shown according to an exemplary embodiment. The bracket defines a first opening configured for the passage therethrough of effluent from a urinal to a soil pipe and one or more second openings configured to receive a fastener passing therethrough to couple the bracket to the urinal. When the bracket is in an installed position, a first side of the bracket compresses a resilient gasket against the urinal adjacent a trapway outlet such that a substantially watertight seal is formed between the trapway and the first opening.

The bracket generally includes a body portion surrounding the first opening and one or more arms outwardly extending from the body portion. The one or more arms are configured to receive a fastener for securing the bracket to the urinal. The portion of the arm that receives the fastener has a front surface that is configured to contact, either directly or indirectly, the urinal during installation. The front surface is spaced forward of a front surface of the body portion that is configured to receive the resilient gasket. Positioning a front surface of the arm forward of a surface of the bracket that is configured to receive or otherwise support a resilient gasket may reduce the amount of flexure realized by the bracket when secured to the urinal.

According to an exemplary embodiment, the bracket may be formed of a substrate formed of a first material that is overmolded (e.g., insert molded, etc.) with a second material that is different than the first material. According to another exemplary embodiment, the bracket may include a recess at least partially around the first opening, on a side opposite the side that is configured to receive or otherwise support the resilient gasket. The recess being configured to substantially isolate any flexure being realized by the one or more arms from the portion of the bracket that defines the first opening.

Before discussing further details of the bracket and/or the components thereof, it should be noted that references to "front," "back," "rear," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 8:
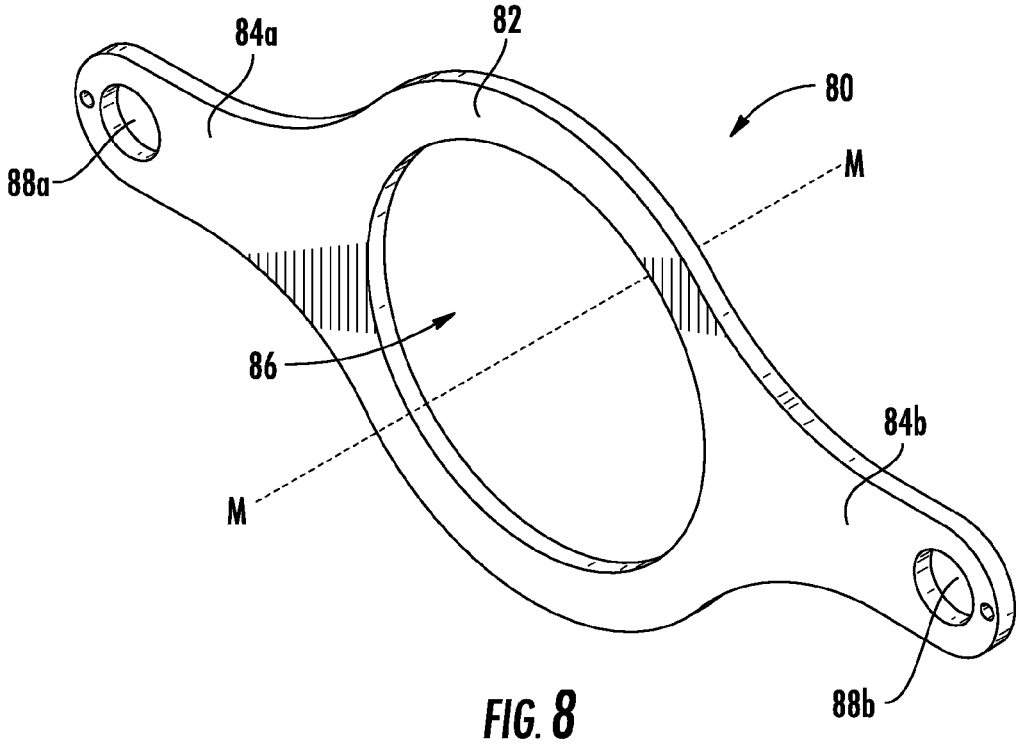
FIG. 8 is a perspective view of a urinal bracket insert, shown according to an exemplary embodiment.
Figure 9:
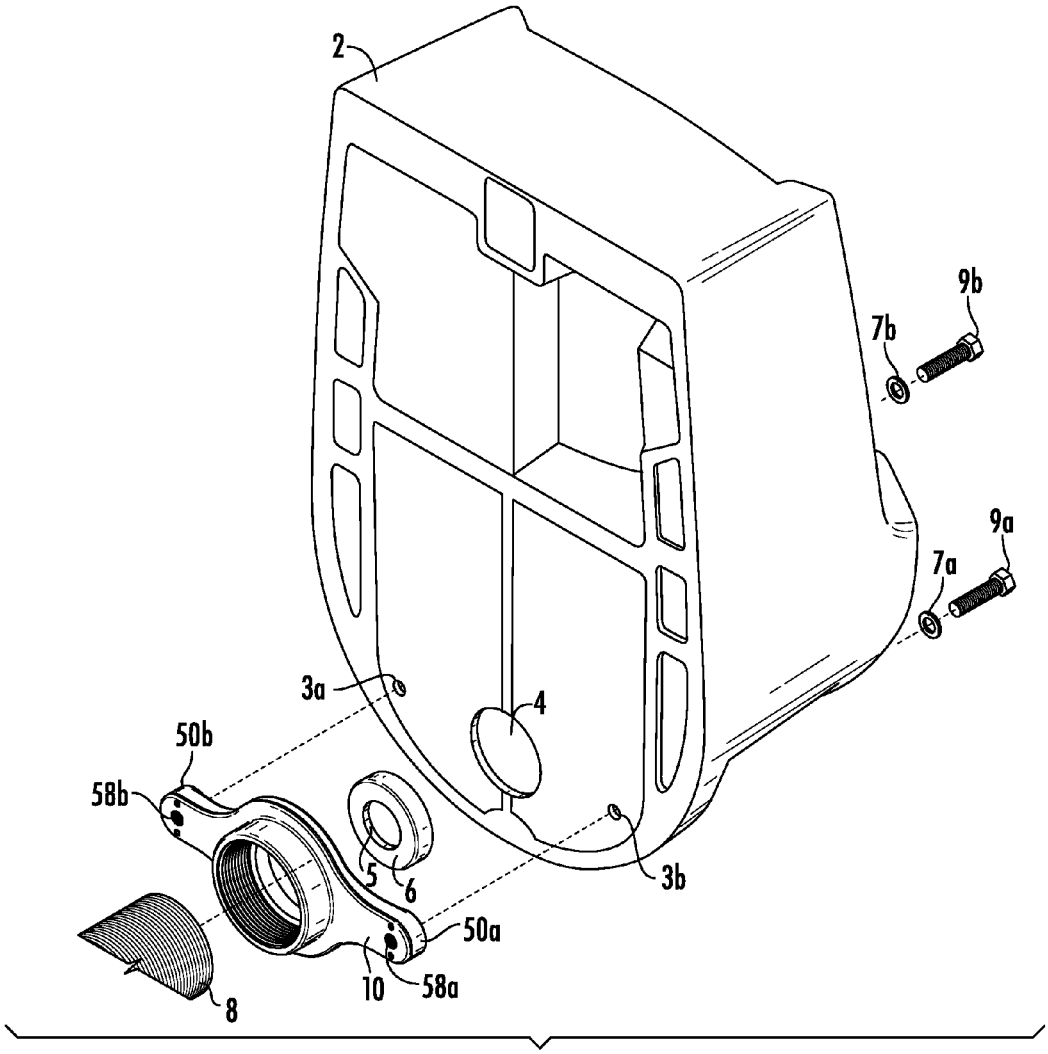
FIG. 9 is an exploded assembly view of the urinal bracket of FIG. 1, a urinal, and related components, shown according to an exemplary embodiment.

Referring to FIGS. 1 and 9, a bracket 10 for coupling a urinal 2 to a soil pipe 8, is shown according to an exemplary embodiment. According to one embodiment, the bracket 10 includes a substrate or insert 80 formed of a first material, shown separately in FIG. 8, which is overmolded or encased in a covering or coating 16 formed of a second material that is different than the first material. The first material may be chosen for its relatively high strength (e.g., resistance to bending, etc.), low cost, and/or ease of formation (e.g., ease of machining, stamping, casting, etc.), while the second material may be chosen for its resistance to corrosion, ease of formation (e.g., ease of machining, molding, etc.), and/or low cost. According to an exemplary embodiment, the insert 80 is formed of carbon steel. According to other embodiments, the insert 80 may be formed of any suitable material having similar properties (e.g., metal, plastic, etc.). According to an exemplary embodiment, the coating 16 is a glass or fiber filled polypropylene. According to other embodiments, the coating 16 may be of any suitable polymeric material, for example, polyester, polyvinyl chloride (PVC), polyethylene (PE), high-density polyethylene (HDPE), acrylonitrile butadiene styrene (ABS), etc., which in turn may be solid or reinforced, for example, glass-filled, talc-filled, fiber-reinforced, etc. The bracket 10 further includes a first side or front side or urinal side 12 (shown in FIG. 2) and a second side or rear side 14 opposite the urinal side 12 (shown in FIG. 3).

Figure 2:
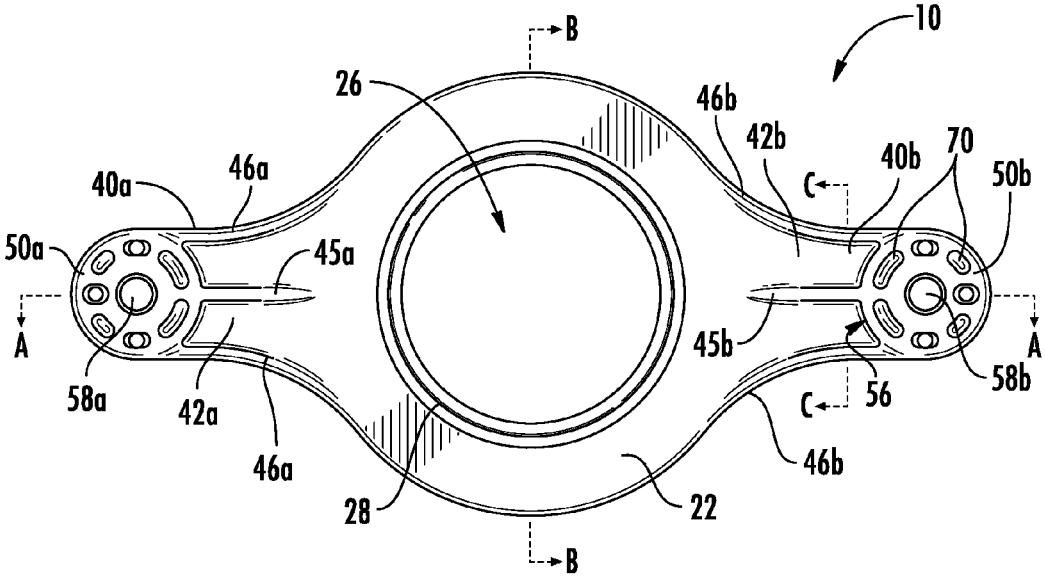
FIG. 2 is a front view of the urinal bracket of FIG. 1, shown according to an exemplary embodiment.
Figure 3:
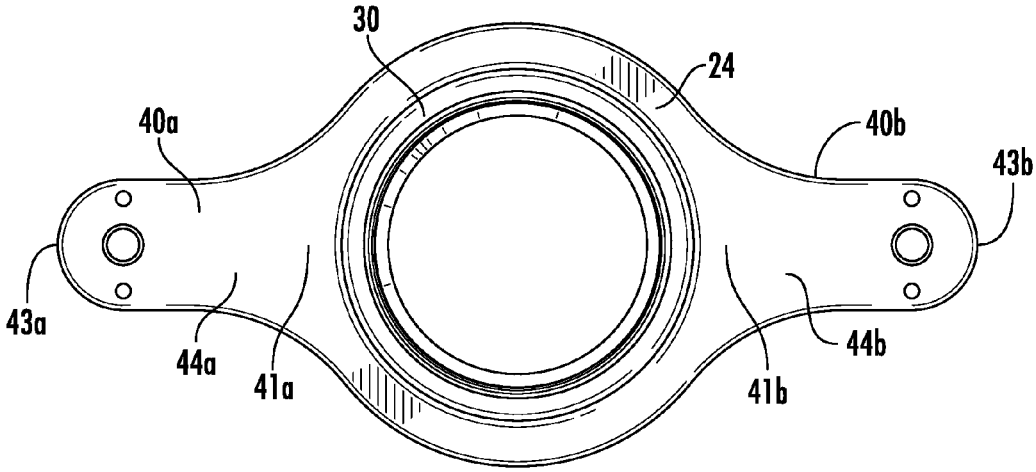
FIG. 3 is a rear view of the urinal bracket of FIG. 1, shown according to an exemplary embodiment.

Referring to FIGS. 1-3, the bracket 10 is shown to include a hub or body portion 20 and one or more arms extending radially therefrom, shown as a first arm 40*a* and a second arm 40*b* (generally referred to as arm 40). The body portion 20 defines a first opening 26 (hole, aperture, etc.) having an axis L, both of which extend through the body portion 20 from the urinal side 12 to the rear side 14. The first opening 26 permits passage of effluent (e.g., water, sewage, etc.) from the urinal 2 to the soil pipe 8. The body portion 20 further includes a first or front surface 22 on the urinal side 12 and a second surface or rear surface 24 on the rear side 14. As shown in FIGS. 5 and 6, the insert 80, having a substantially constant axial thickness, extends through the body portion 20, thereby increasing the strength thereof.

Figure 4:
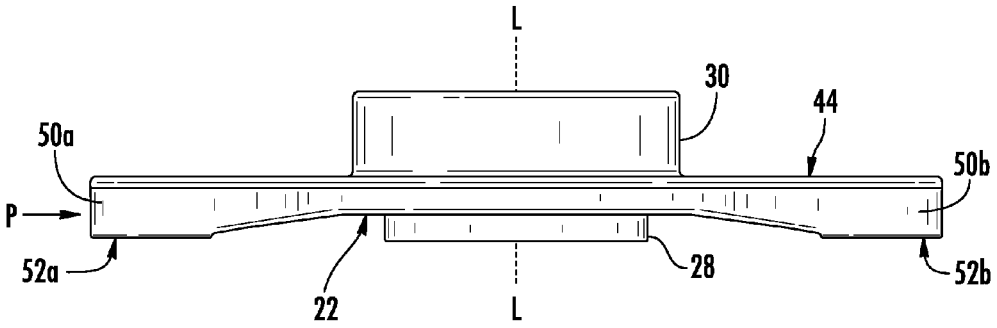
FIG. 4 is a top view of the urinal bracket of FIG. 1, shown according to an exemplary embodiment.

Referring to FIGS. 4-6, the front surface 22 is shown to define a plane P, which is substantially perpendicular to the axis L of the first opening 26, and is configured to receive a resilient gasket 6. A first annular flange or front collar 28 extends axially forward from the front surface 22 and at least partially defines the first opening 26. The front collar 28 is shown to be formed from the coating 16 and to be configured to extend at least partially through the gasket 6. When the bracket 10 is in an installed position, the front surface 22 is configured to press against a rear surface of the gasket 6, and the front collar 28 and the gasket 6 form a substantially watertight seal. According to various other embodiments, the gasket 6 may be integrally formed with or coupled to the bracket 10. For example, the gasket 6 may be integrally formed with the bracket 10 by being integrally molded with the bracket 10 to provided a molded-in gasket. Further still, the insert 80 may extend axially into, and thereby form a portion of, the front collar 28.

A second annular flange or rear collar 30 extends axially rearward from the rear surface 24 and at least partially defines first opening 26. The rear collar 30 is shown to be formed from the coating 16 and to be configured to receive the soil pipe 8. The rear collar may include an internally threaded surface 32, which at least partially defines first opening 26 and is configured the threadably couple the bracket 10 to the soil pipe 8. According to various other embodiments, the rear collar 30 may include external threads for threadably coupling to soil pipe 8 or any other suitable connection mechanism, for example, quick disconnect, sealant, etc., and the insert 80 may extend axially into, and form a portion of, the rear collar 30. Having the insert 80 form a portion of rear collar 30 may increase the radial or circumferential strength of rear collar 30.

Referring to FIGS. 2-4, the first arm 40*a* and the second arm 40*b* are each shown as extending in radially opposite directions from the body portion 20 and being substantially symmetric to one another. The arm 40 extends from a first end portion 41 proximate the body portion 20 to a second end portion 43 distal the body portion 20, wherein a structure (e.g., protrusion, lug, portion, etc.), shown as boss 50, may be disposed on the arm 40 between the first end portion 41 and the second end portion 43. As shown, a first projection or boss 50*a* and a second projection or boss 50*b* are located proximate the respective second end portions 43*a*, 43*b* of the first arm 40*a* and the second arm 40*b*. The arm 40 further includes a first or front surface 42 and a second or rear surface 44. According to the embodiment shown, the rear surface 44 is substantially coplanar with the rear surface 24 of the body portion 20, and portions of the front surface 42 are substantially coplanar with plane P. According to various other embodiments, the bracket 10 may have any number of arms 40 extending from the body portion 20, the arms 40 may or may not be symmetric, and the arms 40 may or may not be oriented in evenly spaced or radially opposite manners.

Figure 5A:
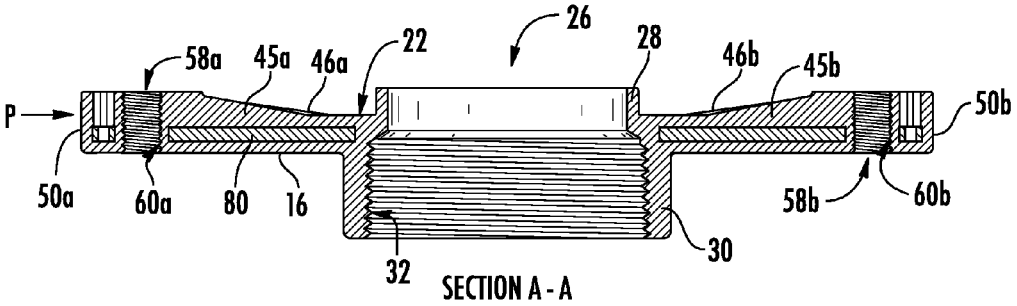
FIGS. 5A-5B are cross-sectional views of the urinal bracket of FIG. 1 through line A-A, shown according to an exemplary embodiment.
Figure 5B:
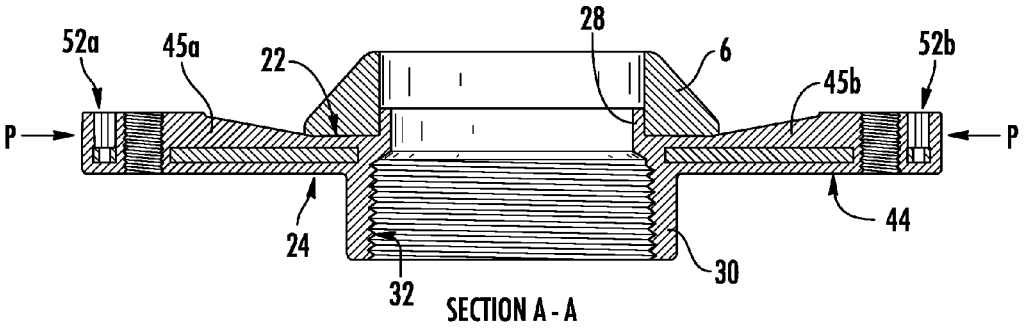
Figure 6:
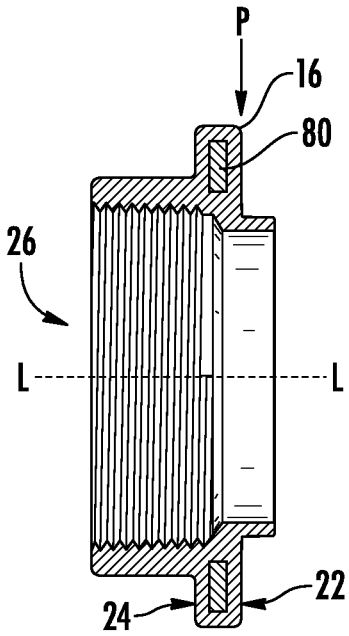
FIG. 6 is a cross-section of the urinal bracket of FIG. 1 through line B-B, shown according to an exemplary embodiment.
Figure 7:
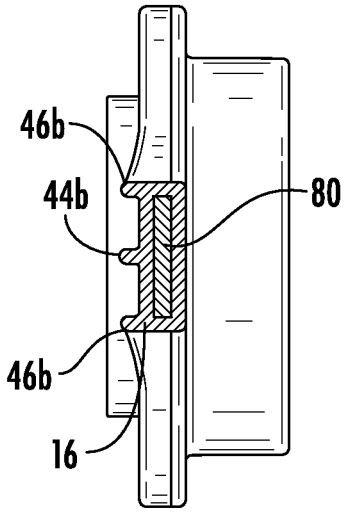
FIG. 7 is a cross-section of the urinal bracket of FIG. 1 through line C-C, shown according to an exemplary embodiment.

Referring to FIGS. 4, 5A and 5B, the boss 50 includes a forward surface 52, a rearward surface, shown to be an extension of rear surface 44, and a sidewall 54, which extends axially from plane P away from the rear side 14 of the bracket 10. The boss 50 further includes an opening 58 extending axially through the boss 50, the opening being configured to receive a fastener 9 (e.g., bolt, screw, stud, etc.) passing therethrough to couple the bracket 10 to the urinal 2 and to provide a sufficiently compressive load between the bracket 10 and the urinal 2 such that the gasket 6 forms a substantially watertight seal. According to the embodiment shown, first boss 50*a* includes an opening 58*a*, and second boss 50*b* includes an opening 58*b*.

According to one embodiment, the forward surface 52 of the boss 50 is axially spaced apart from plane P and the front surface 22 of the body portion 20 in a forward direction. According to another embodiment, the front surface 22 of the body portion 20 is recessed from the forward surface 52.

According to an exemplary embodiment, the boss 50 is configured such that the forward surface 52 contacts a rear surface of the urinal 2 when the bracket 10 is in an installed position. Having the forward surfaces 52 contact the urinal 2 may provide positive feedback to an installer that the fasteners 9 have been sufficiently tightened. Providing such positive feedback reduces overtightening by the installer during the installation process. Further, positioning the forward surface 52 of the boss 50 forward of the plane P enables the forward surface 52 to contact the urinal 2 while compressing the gasket 6 less, thereby reducing flexure across the body portion 20 when the bracket 10 is in an installed position. Reducing flexure across the body portion 20 may provide a more constant sealing pressure between the bracket 10 and the gasket 6, thereby creating a more robust (e.g., more watertight) seal.

According to an exemplary embodiment, the axial distance from the forward surface 52 of the boss 50 to the front surface 22 of the body portion is selected depending at least partially on the thickness and/or compressibility of the gasket 6. For example, if the gasket 6 were relatively thin and/or compressible, the boss 50 could have less axial thickness, thereby allowing the bracket 10 to draw closer to the urinal 2 and compressing the gasket 6 to form a substantially watertight seal. If, for example, the gasket 6 were relatively thick and/or incompressible, the boss 50 could have greater axial thickness, which would enable the forward surface 52 to be closer to the urinal 2 even though the body portion 20 is held away from the urinal by the gasket 6. Having the forward surface 52 closer to the urinal 2 may give the fasteners 9 better reach (i.e., enables the use of shorter fasteners 9).

Figure 13:
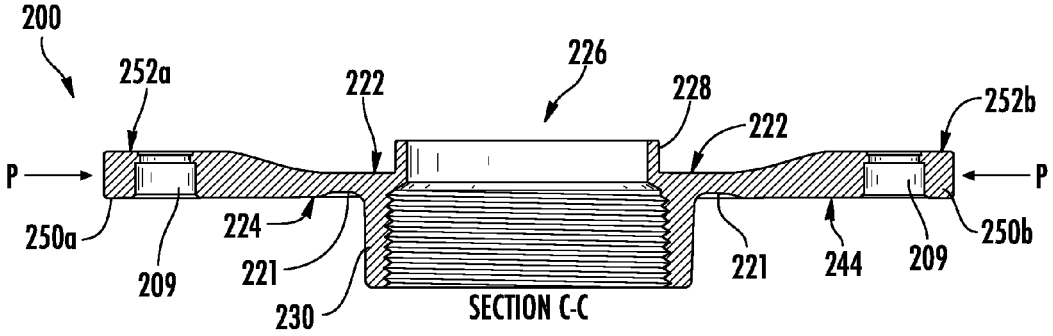
FIG. 13 is a cross-sectional view of the urinal bracket of FIG. 11 through line C-C, shown according to an exemplary embodiment.

The boss 50 is shown to further include a threaded surface 60, which at least partially defines opening 58 and is configured to threadably couple to fastener 9. As shown in FIG. 9, the fastener 9 extends rearward through the urinal 2, and the threaded surface 60 may receive the fastener 9 and thereby be pulled towards the urinal 2. According to another embodiment, the fastener 9 may extend forward through the bracket 10 and the urinal 2 to a nut, and threaded surface 60 retains the fastener 9 such that the fastener 9 does not inadvertently dislodge from of the bracket 10 (e.g., fall down into the wall). According to an exemplary embodiment, the threaded surface 60 is formed in the coating 16 in the opening 58, for example, during an injection molding process or a tapping process. Referring briefly to FIG. 13, the threaded surface may be an exposed portion of a nut 209 is coupled to bracket 10 during the molding process. It is further contemplated that the opening 58 may not include a threaded surface 60, and that the fastener 9 may couple to the bracket 10 using another suitable mechanism, for example, a fastener-nut system, a fastener-snap ring system, a radially enlarged head of a forward facing fastener 9 may be retained by rear surface 44, a forwarding extending stud may be formed into the bracket 10 during the overmolding process, etc.

Referring to FIG. 2, each arm 40 may include one or more ribs 45, 46 (e.g., flanges, ridge, protrusions, web, etc.) sweeping forward from the body portion 20 to the boss 50. The ribs 45, 46 are shown to extend axially forward from front surface 42 while extending along the arm 40 from the body portion 20 to the boss 50. According to the embodiment shown, each arm 40 includes a center rib 45 extending radially from the first opening 26 and a pair of outside ribs 46 disposed circumferentially on either side of the center rib 45 and extending tangentially from the boss 50 along and substantially defining an edge of the arm 40. As the outer ribs 46 approach the body portion 20, they are shown to flare outward, to blend with an outer periphery of the body portion 20. Changing the direction of the outer ribs 46 from parallel with the center rib 45 to include a circumferential component increases the torsional rigidity of the arms 40. As shown, the ribs 45, 46 are formed from the coating 16 overmolded onto the insert 80; however, in other embodiments, the insert 80 may extend into and form a portion of the ribs 45, 46. Forming the ribs in the insert 80 may increase the strength of the insert 80 and thereby increases the strength and deflection resistance of the bracket 10.

Referring to FIGS. 2 and 5, the ribs 45, 46 are tapered, increasing in axial thickness from the body portion 20 to the boss 50 and forming a web between the front surface 42 and the sidewall 56 of the boss 50. Such a configuration may allow the arms 40 to resist deflection during installation of the bracket 10. According to an exemplary embodiment, the taper of the arms 40 corresponds to the compressibility of the gasket 6. For example, if the gasket 6 were relatively incompressible, the arms 40 may have a greater taper, which in an installed position places forward surface 52 closer to the urinal 2 relative to the body portion 20 and takes advantage of the thicker boss 50 to increase the size and strength of the rib 45, 46. However, if the gasket 6 were relatively compressible, the arms 40 may have a lesser taper because the body portion 20 may be drawn closer to the urinal without creating as great of a bending stress in the arms 40. Providing taper to the ribs and blending the outside ribs 46 to the periphery of the bracket 10 may increase the strength of the bracket 10 to resist bending, deflection, and/or deformation, and/or may improve the laminar flow of the plastic during an injection molding process. Various other embodiments may have rib configurations different than that described, may not have ribs 45, 46, or may have the entire arm 40 increase in thickness. Conventional loading structures are located on the rear side 14 of the bracket 10, where the loading structures are subject to tensile stresses. Placing ribs 45, 46 on the urinal side 12 subjects the ribs to compressive stresses and focuses the flex area on the desired geometry to carry the load.

Referring to FIGS. 5-8, with specific reference to FIG. 8, the bracket 10 is shown to include an overmolded substrate or insert 80 having a first or base portion 82 and one or more arms 84 extending therefrom. The insert 80 may increase the strength of the bracket 10 to resist bending, deflection and/or deformation during the installation process. The insert 80 may be formed of any suitably rigid and strong material (e.g., plastic, metal, etc.). Metals tend to be harder than the vitreous enamel surfaces on many urinals, which may cause chipping of the vitreous surface if they were to directly engage the urinal. Further, some metals that may be suitable for the insert 80 (e.g., carbon steel) may be susceptible to corrosion. At least partially encasing the insert 80 in the coating 16 may overcome one or ore of the shortcomings of such materials and allow them to be used in urinal applications. Furthermore, as described above, the coating 16 may be formed to provide localized reinforcements to the bracket 10.

The base portion 82 defines a first opening 86 having an axis M and configured for the passage therethrough of effluent from the urinal to the soil pipe. When assembled, the axis M is substantially collinear with the axis L of the bracket 10. The first opening 86 is shown to have a greater diameter than the diameter of the first opening 26 of the bracket 10, such that the inner periphery of the first opening 86 is separated from, and thereby protected from, effluent by the coating 16.

Insert 80 is shown to have a first arm 84*a* and second arm 84*b*, which extend in radially opposite directions from the base portion 82. Each arm 84 includes an axially extending opening 88, shown as second opening 88*a* and third opening 88*b*, each configured to receive a fastener passing therethrough to couple the bracket 10 to the urinal 2. According to an exemplary embodiment, the second opening 88*a* and the third opening 88*b* are substantially concentric with the second and opening 58*a* and the third opening 58*b* of the bracket 10, respectively. According to other embodiments, the insert 80 may have any number of arms 84 extending from the base portion 82, wherein the arms 84 may or may not be oriented in evenly spaced or radially opposite manners.

The insert 80 is further shown to be a singular, substantially planar component having a substantially constant axial thickness. According to other embodiments, the insert 80 may include a plurality of separate or coupled components or may be non-planar, for example, the insert 80 may be formed with ribs. Having ribs increases the strength of the insert, thereby increasing its ability to resist bending. The insert 80 may be formed in any suitable manner, for example, stamping, extrusion, machining, sintering, etc.

Referring to FIG. 9, assembly of the bracket 10 to an installed position is described according to an exemplary embodiment. The bracket 10 is coupled to the soil pipe 8 to form a substantially watertight seal between the bracket 10 and the soil pipe 8. According to an exemplary embodiment, the rear collar 30 is threaded onto the soil pipe 8. According to other embodiments, the bracket 10 may be threaded onto a nipple or other intermediary section between the bracket 10 and the soil pipe 8. An inner surface 5 of the gasket 6 is seated onto front collar 28 such that the front collar 28 supports the gasket 6. The urinal 2 is mounted to a wall such that the gasket 6 is aligned with the trapway outlet 4 on the rear surface of the urinal 2. A first fastener 9*a* is inserted through a first opening 3*a* in the urinal 2 to the opening 58*a* in the bracket 10. The threads of fastener 9*a* engage threaded surface 60 of the bracket 10, and fastener 9*a* is tightened. Similarly, a second fastener 9*b* is inserted through a second opening 3*b* in the urinal 2 to engage a threaded surface 60 in a second opening 58*b* of the bracket 10, and fastener 9*b* is tightened. The fasteners 9*a*, 9*b* are both tightened until the forward surfaces 52*a*, 52*b* of the bosses 50*a*, 50*b* contact the rear surface of the urinal 2. As the fasteners 9 are tightened, the bracket 10 is drawn toward the urinal 2, thereby compressing or crushing the gasket 6 therebetween to form a substantially watertight seal between the trapway outlet 4 and the bracket 10. As shown, washers 7*a*, 7*b* may be used between the front surface of the urinal 2 and the fasteners 9*a*, 9*b*.

Figure 10:
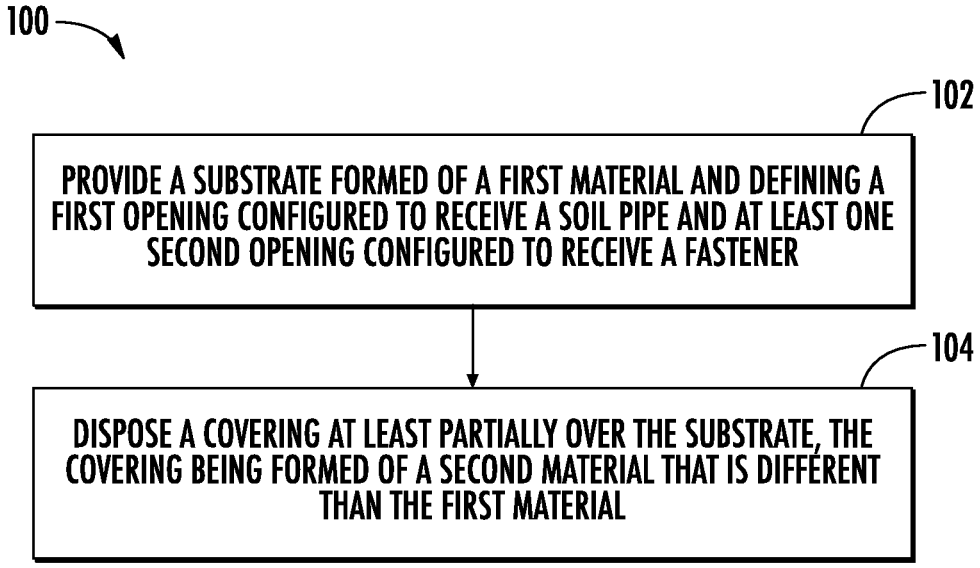
FIG. 10 is flowchart of a process for manufacturing a urinal bracket, shown according to an exemplary embodiment.

Referring to FIG. 10, a flowchart of a process for manufacturing a urinal bracket is shown, according to an exemplary embodiment. Process 100 is shown to include the steps of providing a substrate 80 formed of a first material and defining a first opening configured to receive a soil pipe and at least one second opening configured to receive a fastener (step 102) and disposing a covering at least partially over the substrate, the covering being formed of a second material that is different than the first material (step 104). According to an exemplary embodiment, the first material is a metal (e.g., carbon steel) and the second material is a plastic (e.g., glass-filled polypropylene, etc.). According to an exemplary embodiment, step 104 is accomplished using injection molding techniques. According to one embodiment, step 104 includes overmolding (e.g., insert molding, etc.) a plastic material over the entire substrate. Other suitable techniques are contemplated, for example, in an embodiment in which the ribs 45, 46 are formed on the substrate 80, the substrate 80 may be dipped in, sprayed with, or otherwise coated with the second material. Process 100 may include additional steps. For example, a flashing may be deposited (e.g., sprayed, electro-deposition, etc.) on the substrate 80 to improve the adherence of the covering (e.g., coating 16) to the insert 80. For example, one or more elements (e.g., front collar 28, rear collar 30, boss 50, and/or ribs 45, 46) may be formed from the second material on the bracket 10. For example, threads may be formed (e.g., molded, tapped, etc.) in a first opening 26. For example, threads may be formed (e.g., molded, tapped, etc.) in a second opening 58. For example, a nut may be located next to or coupled to the substrate 80 proximate one of the openings prior to disposing the second material over the substrate 80 (step 104), thereby creating a threaded surface in the resulting product. For example, one or more recesses 70 may be formed in the boss 50 to facilitate uniform cooling of the boss 50 after disposing the covering at least partially over the substrate 80.

Figure 11:
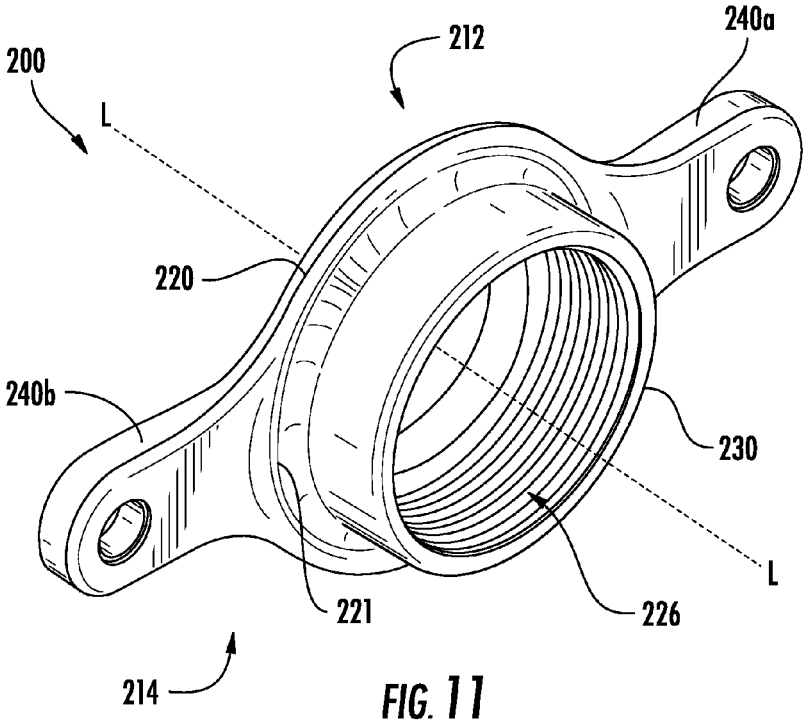
FIG. 11 is a rear perspective view of a urinal bracket, shown according to another exemplary embodiment.
Figure 12:
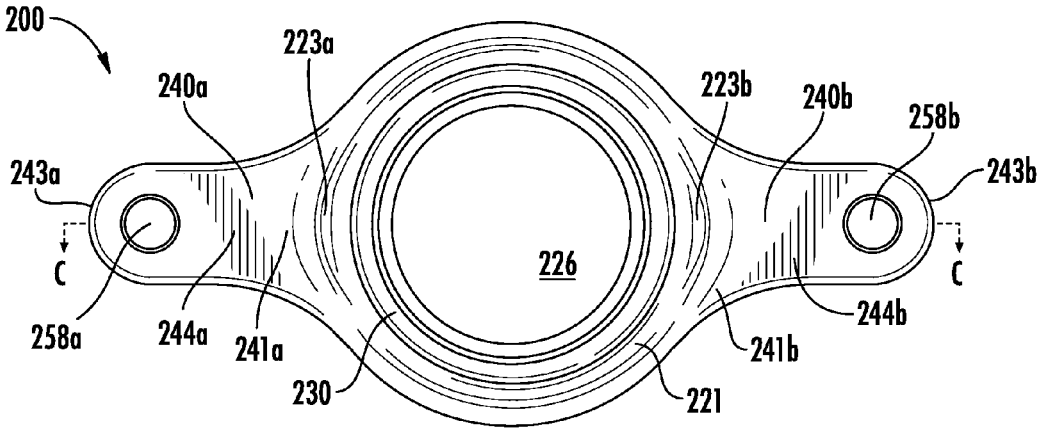
FIG. 12 is a rear view of the urinal bracket of FIG. 11, shown according to an exemplary embodiment.

Referring to FIGS. 11-13, a bracket 210 for coupling a urinal 2 to a soil pipe 8, is shown according to another exemplary embodiment. According to the exemplary embodiment, the bracket 210 is formed of a polymer material that is resistant to corrosion and capable of providing a desired rigidity for the bracket without requiring an insert like the embodiment detailed above. According to an exemplary embodiment, the bracket 210 is formed of a glass or fiber filled polyester resin. According to other embodiments, the bracket 210 formed of any suitable polymeric material having similar properties, for example, polypropylene, polyethylene (PE), high-density polyethylene (HDPE), acrylonitrile butadiene styrene (ABS), polyvinyl chloride (PVC), etc., which in turn may be solid or reinforced, for example, glass-filled, talc-filled, fiber-reinforced, etc. According to other embodiments, the bracket 210 may include a substrate (e.g., insert 80) formed of a second material that may be chosen for its relatively high strength (e.g., resistance to bending, etc.), low cost, and/or ease of formation (e.g., ease of machining, stamping, casting, etc.).

The bracket 210 is shown to include a hub or body portion 220 and one or more arms extending radially therefrom, shown as a first arm 240*a* and a second arm 240*b* (generally referred to as arm 240). The body portion 220 defines a first opening 226 (hole, aperture, etc.) having an axis L, both of which extend through the body portion 220 from a first side or front side or urinal side 212 to a second side or rear side 214 opposite the urinal side 212. The first opening 226 permits passage of effluent (e.g., water, sewage, etc.) from the urinal 2 to the soil pipe 8.

The body portion 220 further includes a first or front surface 222 on the urinal side 212 and a second surface or rear surface 224 on the rear side 214. The front surface 222 is shown to define a plane P, which is substantially perpendicular to the axis L of the first opening 226, and is configured to have a resilient gasket 6 seated thereupon. The gasket 6 may be separate component or may be integrally formed with the body portion 220. For example, the gasket 6 may be integrally formed with the body portion 220 by being integrally molded with the body portion 220 to provided a molded-in gasket. A first annular flange or front collar 228 extends axially forward from the front surface 222 and at least partially defines the first opening 226. When the bracket 210 is in an installed position, the front surface 222 is configured to receive and press against a rear surface of the gasket 6. A second annular flange or rear collar 230 extends axially rearward from the rear surface 224, at least partially defines first opening 226, and is configured the threadably couple the bracket 10 to the soil pipe 8. According to various other embodiments, the rear collar 230 may include external threads for threadably coupling to soil pipe 8 or any other suitable connection mechanism, for example, quick disconnect, sealant, etc.

The first arm 240*a* and the second arm 240*b* are each shown as extending in radially opposite directions from the body portion 220 and being substantially symmetric to one another. The arm 240 extends from a first end portion 241 proximate the body portion 220 to a second end portion 243 distal the body portion 220, wherein a structure (e.g., protrusion, lug, portion, etc.), shown as boss 250, may be disposed on the arm 240 between the first end portion 241 and the second end portion 243. The arm 240 further includes a rear surface 244. Similar to the embodiment detailed above with reference to FIGS. 1-9, a front surface of the boss 250 is positioned forward of the plane P. The combination of the arm 240 and the boss 250 create a forward swept arm that may help reduce the amount of flexure realized by the bracket 210 during installation. The amount of flexure can be reduced because there is less distance between the contact surface of the arm 240 (i.e., boss 250) and the urinal. According to various other embodiments, the bracket 210 may have any number of arms 240 extending from the body portion 220, the arms 240 may or may not be symmetric, and the arms 240 may or may not be oriented in evenly spaced or radially opposite manners.

A recessed portion (e.g., channel, trough, groove, etc.), shown as recess 221, is provided on the rear side 214 of the bracket 210. According to one embodiment, the recess 221 extends at least partially around the first opening 226. According to another embodiment, the recess 221 extends substantially around the first opening 226. According to the embodiment shown, the recess 221 extends around the rear collar 230. According to one embodiment, the recess 221 recedes from the rear surface 224 of the body portion 220. According to another embodiment, the recess 221 recedes from the rear surface 244 of the arm 240. The recess 221 is shown to be disposed substantially on the rear side 214 of the body portion. According to other embodiments, the recess 221 may be disposed at least partially on the rear side 214 of the arms 240.

Figure 14A:
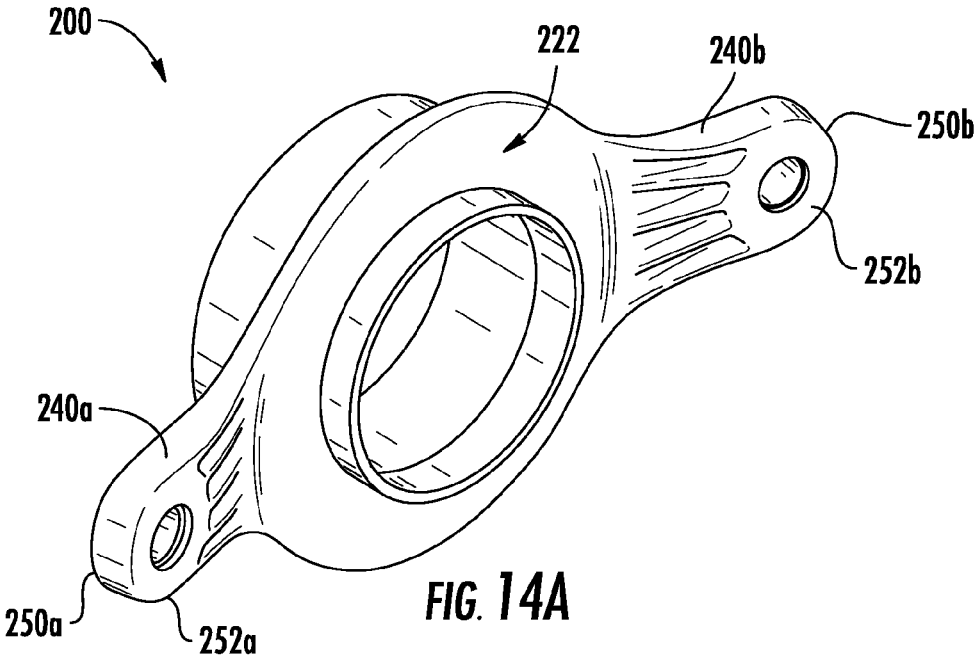
FIGS. 14A-14B are front and rear perspective views of the urinal bracket of FIG. 11 under exaggerated loading, shown according to an exemplary embodiment.
Figure 14B:
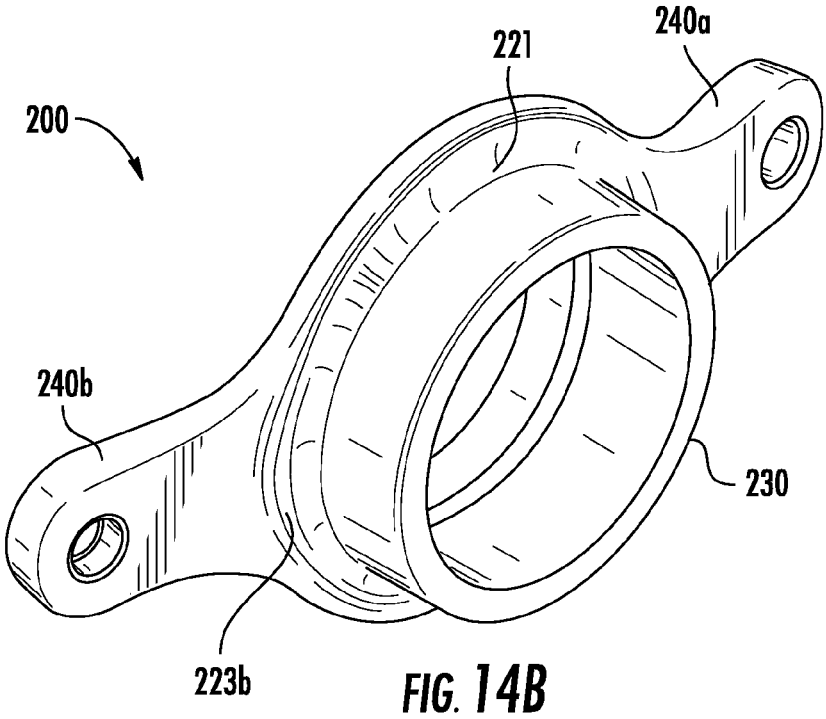
Figure 15:
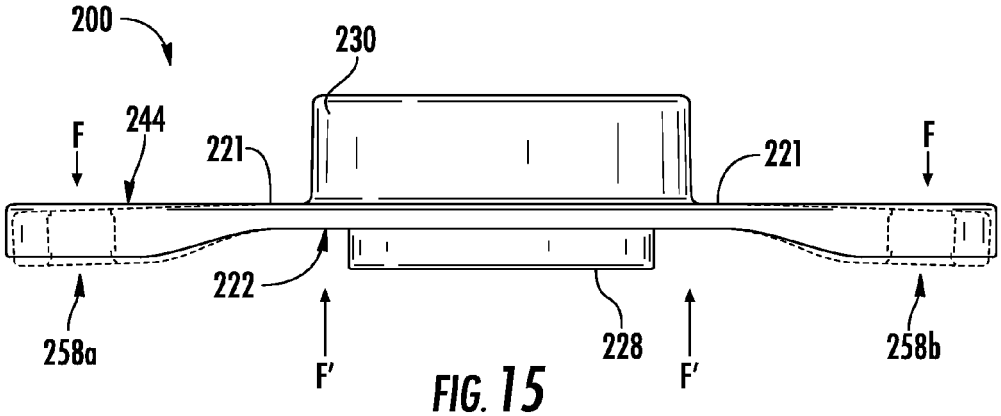
FIG. 15 is a top view of the urinal bracket of FIG. 11, shown in unloaded and exaggerated loaded conditions, according to an exemplary embodiment.

Referring to FIGS. 14A, 14B, and 15, the recess 221 is configured to allow some flexure of the arm 240 relative to the body portion 220 while reducing bending of the body portion 220. As such, the recess 221 isolates or separates the flex of the arm 240 from the body portion 220. Isolating the flex of the arm 240 from the body portion 220 reduces flexing of the rear collar 230, thereby maintaining connection between the soil pipe 8 and the rear collar 230, which in turn provides a better seal between the soil pipe 8 and the rear collar 230. Isolating the flex of the arm 240 from the body portion 220 reduces flexing of the front collar 228 and front surface 222 of the body portion 220, thereby maintaining a better seal between the front collar 228, front surface 222, and gasket 6. Further, reducing flexing across the front surface 222 and front collar 228 provides a more constant sealing pressure between the bracket 210 and the gasket 6, thereby creating a more robust (e.g., more watertight) seal. In a typical installation, the amount of flexing realized by the arms would be minimal and may be barely visible (if at all) to the naked eye. FIGS. 14A, 14B, and 15 have been exaggerated to illustrate their movement.

Referring to FIG. 15, the bracket 200 is shown in a first state (e.g., relaxed state, pre-installation state, undeflected state, unloaded condition, etc.), shown in solid lines, and with an overlay of the bracket in a second state (e.g., installed state, deflected state, loaded condition, etc.), shown in dashed lines. When the bracket 200 is in an installed position, the fasteners 9 apply a first force F to the bracket 200 in a first or forward direction, and the gasket 6 applies a second or reactionary force F' to the bracket 200 in a second or rearward direction. Forces F and F' couple across the bracket 200 to flex the bracket 200 as shown in dashed lines. The recess 221 allows the arms 240 to flex relative to the body portion 220, while substantially isolating the front collar 228, the rear collar 230, and the front surface 222 from flexure. This is evident by FIG. 15, which illustrates that the positioning of the front collar 228 and the rear collar 230 remain the same for both the first and second state.

The recess 221 may have a variety of profiles. According to the embodiment shown, the recess 221 has a substantially U shaped cross-section. According to one embodiment, the recess 221 is substantially annular, extending around the first opening 226. According to the embodiment shown, the recess 221 includes at least one widened portion 223, shown as first widened portion 223*a* and second widened portion 223*b*. As shown, the widened portions 223 extend radially from the first opening 221, giving the periphery of the recess 221*a* somewhat oval shape. The widened portions 223 are shown to be radially aligned with the arms 240. The widened portions are configured to control the flexure of the arms 240 relative to the body portion 220. For example, the widened portions 223 modify the periphery of the recess 221 to better align the periphery with the flexure forces, thereby guiding the flexure forces to the desired geometry to carry the load.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

The construction and arrangement of the elements of the bracket as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and assemblies disclosed herein may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A bracket for coupling a urinal to a soil pipe, comprising:

a body portion defining a first opening configured to be in fluid communication with the soil pipe, the body portion having a first surface configured to receive a resilient gasket;

an arm extending outwardly from the body portion, the arm having a structure configured to receive a fastener for coupling the bracket to the urinal, the structure having a first surface positioned forward of the first surface of the body portion; and a tapered rib extending along the arm from the body portion to the structure, the rib increasing in axial thickness from the body portion to the structure, and being located on a side of the bracket configured to face the urinal.

2. The bracket of claim 1, wherein when the bracket is in an installed position, the bracket is configured to compress the resilient gasket against the urinal, and wherein the forward positioning of the first surface of the structure relative to the first surface of the body portion is configured to reduce bending of the bracket.

3. The bracket of claim 1, wherein when the bracket is in an installed position the first surface of the structure contacts the urinal.

4. The bracket of claim 1, wherein the structure comprises a projection provided at a distal end of the arm.

5. The bracket of claim 1, wherein the resilient gasket is integrally formed with the body portion to provide a molded-in gasket.

6. The bracket of claim 1, further comprising a substrate and a covering, the substrate at least partially defining the body portion and the arm, the substrate being formed of a first material, the covering being at least partially disposed over the substrate, the covering being formed of a second material that is different than the first material.

7. The bracket of claim 1, wherein the body portion further comprises a second surface axially opposite the first surface, the second surface comprising a recess configured to allow flexure of the arm relative to the body portion while reducing bending of the body portion.

8. A mounting device for securing a urinal to a soil pipe, comprising:

a substrate formed of a first material and including a first opening and at least one second opening, the first opening configured for the passage therethrough of effluent from the urinal to the soil pipe and the at least one second opening configured to receive a fastener passing therethrough to couple the mounting device to the urinal; and a covering at least partially disposed over the substrate, wherein the covering is formed of a second material that is different than the first material.

9. The mounting device of claim 8, further comprising:

a first side configured to be positioned adjacent the urinal, and a second side opposite the first side; and an annular flange extending from the first side of the mounting device and at least partially defining the first opening, the flange configured to extend at least partially through a resilient gasket.

10. The mounting device of claim 9, wherein the annular flange is formed of the covering.

11. The mounting device of claim 8, wherein when the mounting device is in an installed position, the mounting device compresses a resilient gasket against the urinal, and wherein the substrate is configured to reduce bending of the mounting device.

12. The mounting device of claim 8, further comprising:

a first side configured to be positioned adjacent the urinal, and a second side opposite the first side;

a body portion at least partially defining the first opening and having an axis extending therethrough from the first side to the second side, the body portion having a forward surface located on the first side; and at least one structure at least partially defining the at least one second opening, the structure comprising a forward surface spaced axially forward from the forward surface of the body portion.

13. The mounting device of claim 8, further comprising:

a body portion at least partially defining the first opening;

at least one structure at least partially defining the at least one second opening;

at least one arm extending radially outward from the body portion to the at least one structure; and a recess extending at least partially around the first opening, wherein the recess is configured to allow flexure of the arm relative to the body portion while reducing bending of the body portion.

14. A bracket for coupling a urinal to a soil pipe, comprising:

a substrate formed of a first material and a covering at least partially disposed over the substrate, wherein the covering is formed of a second material that is different than the first material;

a body portion defining a first opening configured to be in fluid communication with the soil pipe;

an arm extending outwardly from the body portion and configured to receive a fastener for coupling the bracket to the urinal; and a recess provided at least partially around the first opening to allow flexure of the arm relative to the body portion while reducing bending of the body portion.

15. The bracket of claim 14, wherein the body portion includes a first side configured to face the urinal after being installed and a second side opposite the first side, wherein the recess is defined by the second side of the body portion.

16. The bracket of claim 14, wherein the recessed portion extends around the first opening in a substantially continuous manner.

17. The bracket of claim 14, further comprising:

a second arm extending outwardly from the body portion and configured to receive a second fastener for coupling the bracket to the urinal; and wherein when the bracket is in an installed position, the recess is configured to allow the first arm and the second arm to flex relative to the body portion such that the first arm and the second arm at least partially contact the urinal.

18. The bracket of claim 14, wherein the body portion includes a first surface configured to receive a gasket and the arm includes a projection having a surface that is configured to contact the urinal, wherein the surface of the projection is positioned forward of the first surface of the body portion.

19. A bracket for coupling a urinal to a soil pipe, comprising:

a substrate and a covering, the substrate at least partially defining the body portion and the arm, the substrate being formed of a first material, the covering being at least partially disposed over the substrate, the covering being formed of a second material that is different than the first material;

a body portion defining a first opening configured to be in fluid communication with the soil pipe, the body portion having a first surface configured to receive a resilient gasket; and an arm extending outwardly from the body portion, the arm having a structure configured to receive a fastener for coupling the bracket to the urinal, the structure having a first surface positioned forward of the first surface of the body portion.

20. The bracket of claim 19, wherein the body portion further comprises a second surface axially opposite the first surface, the second surface comprising a recess configured to allow flexure of the arm relative to the body portion while reducing bending of the body portion;

wherein the structure comprises a projection provided at a distal end of the arm; and wherein when the bracket is in an installed position, the bracket compresses the resilient gasket against the urinal, and the first surface of the structure contacts the urinal.

21. The bracket of claim 20, further comprising a tapered rib extending along the arm from the body portion to the structure, the rib increasing in axial thickness from the body portion to the structure, and being located on a side of the bracket configured to face the urinal.

* * * * *